US005275407A

United States Patent [19]

Soong

[11] Patent Number: 5,275,407

[45] Date of Patent: Jan. 4, 1994

[54] GRIP OF SPORTS RACKET HAVING RAISED RIDGES

[76] Inventor: Tsai C. Soong, 1839 Jackson Rd., Penfield, N.Y. 14625

[21] Appl. No.: 906,466

[22] Filed: Jun. 30, 1992

[51] Int. Cl.[5] ..... A63B 49/08

[52] U.S. Cl. ..... 273/73 J; 273/75; 273/81.6

[58] Field of Search ..... 273/73.J, 75, 72.R, 72.A, 81.5, 81.6, 81.R

[56] References Cited

U.S. PATENT DOCUMENTS

| | | | |
|---|---|---|---|
| 1,139,843 | 5/1915 | Brown | 273/81.6 |
| 1,891,550 | 12/1932 | Lawrence | 273/81.6 |
| 1,954,275 | 4/1934 | Young | 273/81.6 |
| 3,028,283 | 4/1962 | Lundgren | 273/81 R |
| 3,140,873 | 7/1964 | Goodwin | 273/75 |
| 3,433,481 | 3/1969 | Tanguay | 273/72 R |
| 3,489,031 | 1/1970 | Meier | 273/72 R X |
| 3,845,954 | 11/1974 | Case | 273/75 |
| 4,174,109 | 11/1979 | Gaiser | 273/75 X |
| 4,402,508 | 9/1983 | Pflueger | 273/75 |

FOREIGN PATENT DOCUMENTS

| | | | |
|---|---|---|---|
| 2398099 | 3/1979 | France | 273/81.6 |
| 2057894 | 4/1981 | United Kingdom | 273/72 R |

*Primary Examiner*—William Stoll
*Attorney, Agent, or Firm*—Bernard A. Chiama

[57] ABSTRACT

A sports racket having a handle comprising a shaft with an end cap at its butt end and a gripping device wrapped spirally over the shaft. The gripping device contains a grip strip which has multiple raised ridges embossed at the surface of the grip strip, in a repetitive pattern, protruding outward above the general plane of the surface of the grip strip, thereby to improve gripping quality of the handle. In another embodiment, the gripping device further comprising an insertion device to be inserted in the gaps between side edges of spirally wound adjacent grip strips along the length of the handle.

3 Claims, 4 Drawing Sheets

GRIP OF SPORTS RACKET HAVING RAISED RIDGES

BACKGROUND OF THE INVENTION

The handle of a tennis racket has, at one end, a plastic cap which is an enlarged end piece to support the hand and to prevent the tennis racket from slipping forward. The other end of the handle leads to the head portion of the frame. To enable the hand to hold firmly onto the handle, the prior art always has a soft grip strip wrapped over the shaft along the whole length of the handle. The grip strip, or called grip, in the earlier time, is made of leather, cut into long strip and wrapped spirally around the shaft to make the handle. In recent times, synthetic sponge grips, are also used with increasing popularity. The merit of synthetic sponge grip is that it has better cushioning effect and better moisture absorption and frictional quality than leather.

When the hand is sweaty, the moisture acts as a kind of lubricant, the grip becomes slippery. There are two directions along which the handle may slip: one is along the longitudinal axis of the handle and the other is the rotational direction. The rotational direction slippery is more serious because the diameter of the handle of a tennis racket is small and there is not much moment arm for leverage. An off center-line shot by the ball can easily twist the racket out of control if the grip is slippery.

SUMMARY OF THE INVENTION

The invention proposes that the surface of the grip of the handle of a sports racket, and the tennis racket in particular, is made to have raised ridge patterns along at least the central portion of the length of the strip so that after it is wrapped spirally over the handle, the raised ridges become repeated raised ridge patterns at the exposed surface of the handle which make relative movement between the hand and the handle more difficult. This is a different approach than uniformly increasing the frictional coefficient of the surface of the grip, including multiple raised points or spikes scattered over the surface of the grip. It is to be noted that raised repetitive patterns embossed on the surface of a body to increase its surface traction is not new. The grooved pattern on the tread of the automobile tire is well known. However, these patterns can not be directly copied to the grips on the handle of a tennis racket because the loading carrying characteristic of the auto tire and the way the grip is put on a racket are quite different. The invention proposes to have two kinds of gripping devices. Details are shown in six figures.

DESCRIPTIONS OF THE DRAWINGS

FIG. 1 shows a conventional grip strip.

FIG. 1*a* is a cross-section taken along the line 1*a*—1*a*.

FIG. 2 shows a handle of a tennis racket.

FIG. 2*a* is a cross-section taken along the line 2*a*—2*a*.

FIG. 3 shows an embodiment of a grip strip of the invention.

FIG. 3*a* is a cross-section taken along the line 3*a*—3*a*.

FIG. 4 shows a handle with the grip strip of the invention.

FIGS. 4*a* and 4*b* are cross-sections taken along the lines 4*a*—4*a* and 4*b*—4*b*, respectively.

FIG. 5 shows another embodiment of the gripping device of the invention.

FIGS. 5*a* and 5*b* are cross-sections taken along the lines 5*a* and 5*b*, respectively.

FIG. 6 shows another embodiment of a grip strip of the invention.

FIG. 6*a* is a cross-section taken along the line 6*a*—6*a*.

DESCRIPTION OF THE PREFERRED EMBODIMENT

Figure 1:
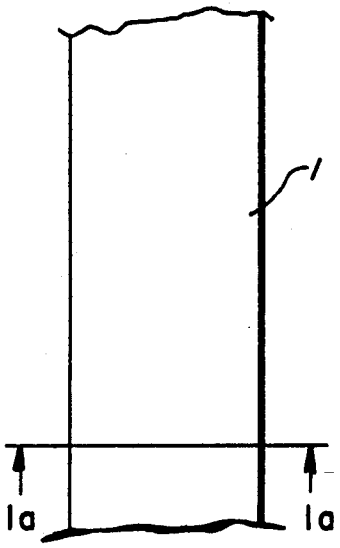
PRIOR ART FIG. 1

FIG. 1 shows a prior art grip strip 1 used for wrapping on the surface of the shaft to form the handle of a sports racket. The cross section of FIG. 1*a* of the strip shows the beveled edge 2, the underside 3 and the non-slippery, gripping surface 4. The underside is often coated with adhesive for permanently fixing the strip onto the surface of the shaft to make the handle.

Figure 1A:
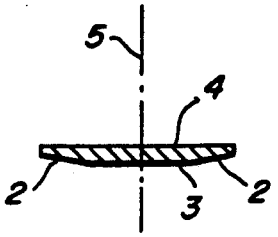
PRIOR ART FIG. 1a
Figure 2:
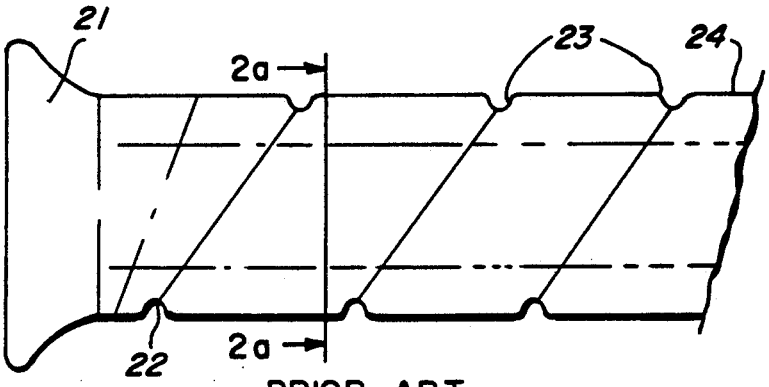
PRIOR ART FIG. 2
Figure 2A:
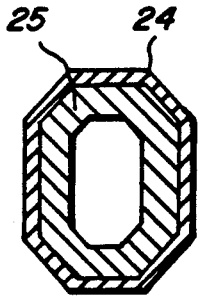
PRIOR ART FIG. 2a

FIG. 2 shows the end portion of a conventional tennis racket handle, comprising an end cap 21 installed at end 22 in a shaft. The cross section of FIG. 2*a* shows a polygon interior. The spiral groove 23 is formed along the handle by the beveled edges 2 shown in FIG. 1 of the grip strip. The grip strip 24 wraps over the polygon shaft 25. There is a lead portion of the grip strip to cover the end cap part of the handle, then the long middle portion where the present application applied, and the end portion which terminates the grip. The conventional grip strip of FIG. 1*a* is characterized by the its symmetry about the width axis 5 and that there is no material above the upper general surface. The trough-like groove 23 plays a key role for a good grip. When leather is used, all one can do is to taper the side edges of the strip, which creates the trough after the strip is spirally wound on the shaft. When synthetic material is used and grip strip is made by molding, the industry still dutifully copied the geometry of the leather strip. No one dared to be innovative. The present invention is aimed to explore improvement through modifying details of the grip strip.

Figure 3:
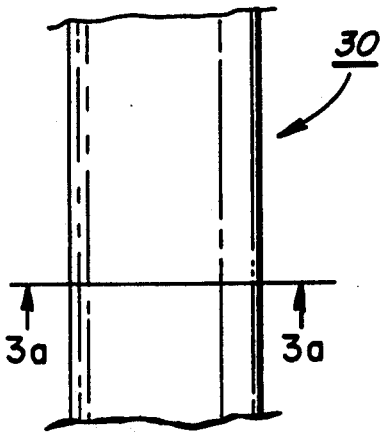
Figure 3A:
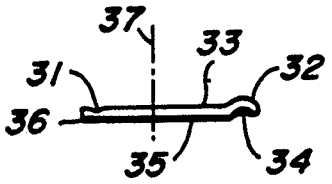
Figure 4:
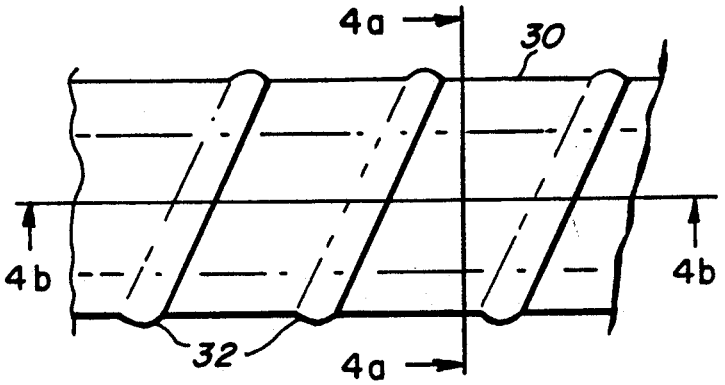
Figure 4A:
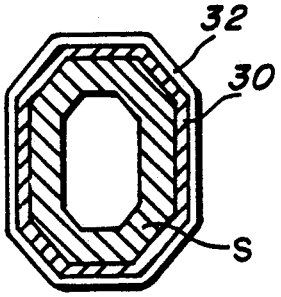
Figure 4B:
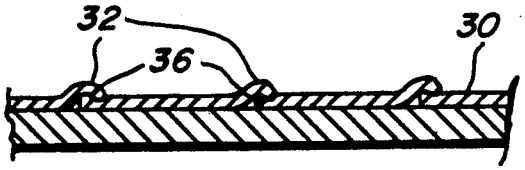

FIGS. 3 and 3*a* show a preferred embodiment of the invention grip strip 30, having a groove 31 and a raised ridge 32, made along the side edges as shown, at the gripping surface 33. There is a cavity 34 under 32 at the underside 35 which is used to capture the convex edge 36 when the strip is spirally wound along the shafts and two strips becoming adjacent to each other. The cross section of FIG. 3 is characterized by the fact that it is not symmetric to the width axis 37 and one side edge is designed to trap the other side edge in a conjugative, self-locking way after the strip is wrapped spirally along the shaft. Of course, a similar design which is symmetric to the width axis 37 is possible. FIG. 4 shows the grip strip 30 is wrapped spirally on the shafts. The underside of the strip should have adhesive applied. Section FIG. 4*b* shows the raised ridge 32, with 36 captured inside 34, runs spirally like a screw thread, providing a physical barrier to enhance holding of the handle by the hand.

It is to be noted that the cross section of the grip strip shown in FIGS. 3 and 4 may be varied in details. The groove 31 may be flat and slot 34 may be filled so that 36 is no longer being captured nor is even under 32. Other variations are possible. In principle, the left edge of the strip is not symmetric to the right edge. One of the edges should have a raised ridge as 32, rising above the plane of the gripping surface, which runs spirally like a screw thread after the grip strip is wrapped over the shaft. Such a raised ridge is not possible from a leather grip which can only have a spiral, trough-like inward groove 23 whose gripping effect is obviously not as good as the raised ridge whose height, width and surface roughness may be varied by molding.

Figure 7:
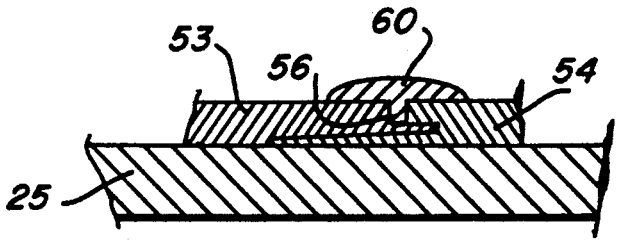
FIG. 7 is a partial cross-sectional view of a detail of the present invention.
Figure 8:
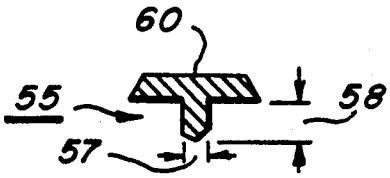
FIGS. 8 and 9 are cross-sectional views of different forms of a detail for use in the embodiment of FIG. 7.
Figure 9:
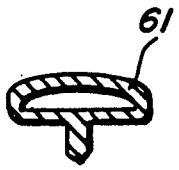

FIGS. 5–10 show another preferred embodiment which resembles FIGS. 3 and 4, but with significant differences. The grip strip 51 shown in FIGS. 7, *7a* has no significant tapering at its edges. It is essentially a strip which maintains adequate thickness near or at the side edges. When it is spirally wrapped around the shaft, a small gap 52 should be kept between adjacent parallel strips 53 and 54 as shown in FIG. *5b*. The adjacent strips 53 and 54 may be distinctly separate or overlapped slightly with each other with gap 52 maintained. FIG. 8 shows the cross section of a long T-section insertion strip 55, with a leg 56 and a top 60. The leg 56 has a width 57 approximately equal to the gap 52. After strip 51 is spirally wrapped over the shaft, the T-section strip 55 is to be inserted into the gap 52 and the top 60 is supported by the shoulders of the adjacent side edges. The top 60 of the T-section strip can be tightly pressed against the strip by the tension force in 55. Adhesive may be applied between all contact surfaces. The grip strip 51 may use leather or synthetic materials, and the T-section 55 may use plastics or synthetics, such as elastomers. Since the leg 56 should be relatively stiff whereas the top 60 should be frictional and elastic, their materials may be different and assembled as a long strip. FIG. 7 illustrates a genetric embodiment in which the leg 56 is very small, the top 60 is merely positioned over the seam made by 53 and 54, and the two are overlapping and supporting each other.

Another preferred arrangement of embodiment of FIGS. 5–9 is to have the grip strip 53, 54, soft, thick and spongy, so that the T-section is wedged below the general surface of the strip 53, 54, and the spiral top 60 sinks below the surface. One can visualize the shape in FIG. 7 with 60 sinks below the surface of 53 and 54. A trough-like, deep, spiral groove is formed with puffy cushioned 53 and 54 between troughs will provide an excellent grip.

The cross section of 55 does not have to be exact as a T as shown in FIG. 8. T-section may be modified to a cross as + which is not shown. The top 60 may be hollowed as 61 in FIG. 9 which can be filled with soft material, or air, or others, so as to improve cushion effect. In summary, the characteristics of the gripping device of FIGS. 5–9 is to introduce a separate, simple, mutually supportive structural element into the conventional one-element grip strip system, so that the system's cushioning effect, friction, and gripping mechanism can be substantially improved.

Figure 5:
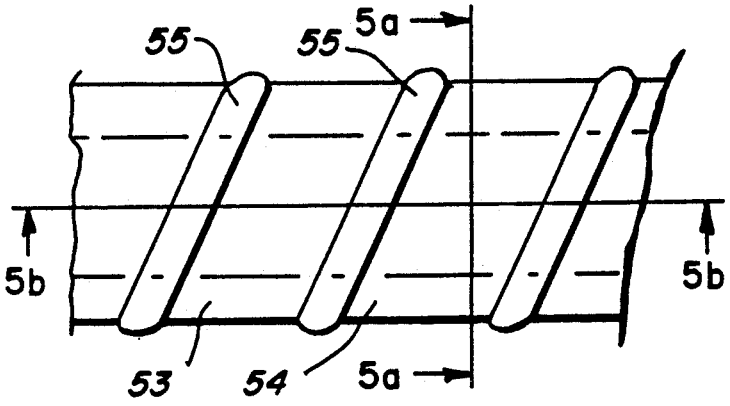
Figure 5A:
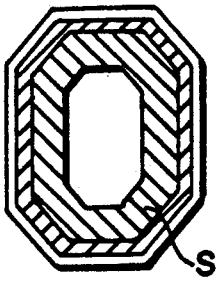
Figure 5B:
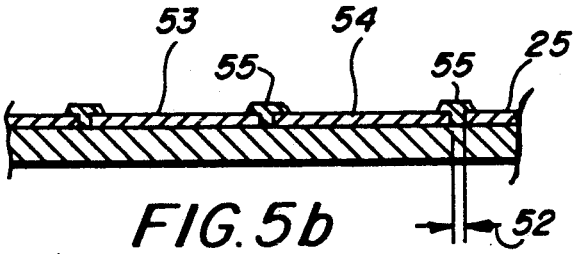
Figure 6:
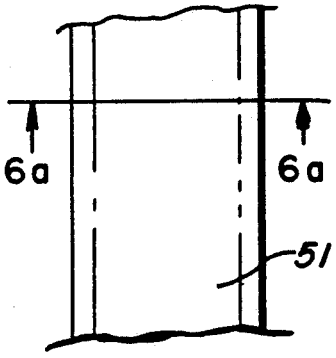
Figure 6A:
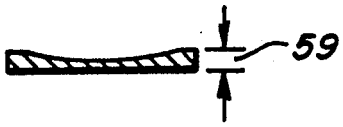

FIGS. 3, 4, and 5 are embodiments for the first kind of grip strips where the parallel edges are modified to have raised ridges to improve gripping. The second kind of embodiment is shown in FIG. 10.

Figure 10:
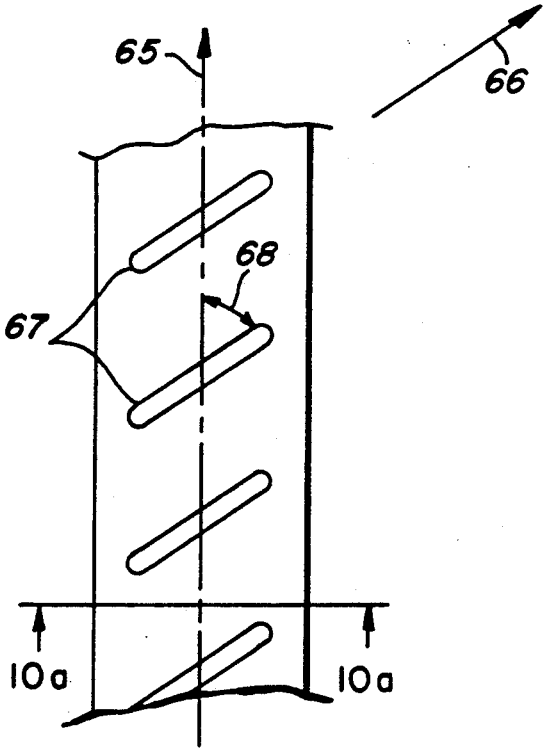
FIG. 10 is another embodiment of a grip strip in the present invention.
Figure 10A:
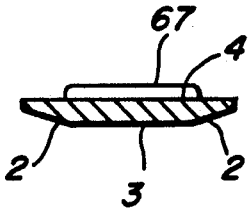

FIGS. 10 and 10*a* shows an embodiment of a raised ridge pattern in the interior of the strip between the parallel side edges to further improving gripping effect. The grip strip 1 is spirally wrapped over the shaft, the axis of the handle is 66 and the axis of the grip strip is 65. The spiral angle 68 is the angle between 65 and 66. The improvement is the raised ridges 67 which are patterns repetitively embossed on the grip surface 4 of the grip strip. They may be of the same material as the strip or they may be of a different material than the grip strip and fastened on to the surface by mechanical or other means. The raised ridge as shown in FIG. 10 is a simple straight bar-type ridge which is at an angle 68 with the axis 65. The pattern and the angle could be varied arbitrary. If angle 68 is zero degree, the raised ridge is a narrow, straight, raised spine. After winding over the shaft, it is a screw thread type ridge on the surface of the handle. Other practical pattern than a bar is possible. Wedge-like patterns or other complicated patterns similar to automobile tire thread are possible patterns.

It is to be noted that small holes are often made in the conventional grip strips for ventilation purpose and the surface of the grip is often made rough, or with sharp spikes, for frictional purpose. However, the raised ridge pattern which protrudes substantially out of the general surface plane of the strip offers an entirely different and much more effective resistance to the slipping between the hand and the handle. Friction is a phenomenon of incompatible surface ruggedness of two contact surfaces their overall dimensions are basically compatible. On the other hand, the repetitive, protruding, raised ridge patterns suggested by the invention, is basically dimensionally incompatible with the hand's hold. If the bones of the holding hand is taken as rigid and the flesh taken as unyielding too, the raised ridges have to be crushed and bulldozed to the level of the general surface of the grip strip in order to become slippery and the handle is let go. That is the fundamental difference with the prior art.

What is claimed is:

1. A sports racket having a handle comprising a shaft with an end cap at the butt end thereof and a gripping device wrapped spirally over the shaft wherein the gripping device comprises a grip strip having a lead portion arranged to initiate the wrapping of the gripping device onto the butt end of the shaft, a middle portion which covers the majority of the length of the handle, and an end portion which terminates the wrapping at the other end of the handle, said middle portion having a grip surface, an underside contacting the shaft, and two parallel side edges defining the width along the length of said middle portion of said grip strip, said gripping device having raised ridges arranged in a repetative pattern, protruding outward above the grip surface, thereby improving the gripping quality of the gripping surface, and wherein the grip strip is spirally wrapped around the shaft with said middle portion arranged to form a narrow gap between said side edges, said gripping device further including an insertion device adapted to be positioned in said gap for at least the majority of the length of said middle portion, and wherein said insertion device comprises an approximately T-shaped cross-section having a vertical leg and a top wherein the vertical leg is to position the device along the gap between side edges of adjacent grip strips and the top is to cover the side edges which is supporting the insertion device.

2. A sports racket having a handle including a shaft with an end cap at the butt end thereof, and a gripping device wrapped spirally over the shaft wherein the gripping device comprises, a lead portion arranged to initiate the wrapping of the gripping device onto the butt end of the shaft, a middle portion covering the majority of the length of the handle, and an end portion which terminates the wrapping at the end of the handle, said middle portion containing at least a grip strip having two parallel side edges defining the width of said middle portion, said grip strip being spirally wrapped around the shaft to form narrow gaps between the sides edges thereof, and an insertion device adapted for positioning in the gaps between said side edges of said spirally wrapped grip strip for along at least the majority of the length of said middle portion and protruding outward beyond the outer surface of said grip strip.

3. The sports racket as defined in claim 2 wherein said side edges of said middle portion are adapted to become engaged with the adjacent side edge of said insertion member in a conjugative and self-locking manner after said griping member is wrapped spirally along the shaft.

* * * * *